United States Patent [19]

Yuasa

[11] Patent Number: 4,924,417

[45] Date of Patent: May 8, 1990

[54] ENVIRONMENTAL ABNORMALITY ALARM APPARATUS

[75] Inventor: Hayami Yuasa, Tokyo, Japan

[73] Assignee: Nittan Co., Ltd., Tokyo, Japan

[21] Appl. No.: 171,467

[22] Filed: Mar. 21, 1988

[30] Foreign Application Priority Data

Apr. 8, 1987 [JP] Japan ..... 62-84650

[51] Int. Cl.[5] ..... G08B 26/00; G08B 23/00

[52] U.S. Cl. ..... 364/550; 365/185; 340/500; 340/825.08; 340/506

[58] Field of Search ..... 364/184, 185, 550, 555, 364/557; 340/584, 628, 629, 632, 825.08, 500, 505, 506, 521

[56] References Cited

U.S. PATENT DOCUMENTS

| | | | |
|---|---|---|---|
| 4,420,746 | 12/1983 | Malinowski | 340/629 |
| 4,525,700 | 6/1985 | Kimura et al. | 340/505 |
| 4,581,604 | 4/1986 | Kimura et al. | 340/521 |
| 4,638,304 | 1/1987 | Kimura et al. | 340/632 |
| 4,658,243 | 4/1987 | Kimura et al. | 340/825.08 |
| 4,668,939 | 5/1987 | Kimura et al. | 340/505 |
| 4,740,787 | 4/1988 | Kimura | 340/506 |
| 4,745,399 | 5/1988 | Kimura | 340/632 |
| 4,750,142 | 6/1988 | Akiba et al. | 364/550 |
| 4,785,284 | 11/1988 | Kimura | 340/505 |
| 4,797,664 | 1/1989 | Kimura | 364/184 |
| 4,803,469 | 2/1989 | Matsushita | 340/628 |
| 4,816,808 | 3/1989 | Morita | 340/505 |
| 4,831,361 | 5/1989 | Kimura | 340/500 |

*Primary Examiner*—Parshotam S. Lall
*Assistant Examiner*—Christopher L. Makay
*Attorney, Agent, or Firm*—Hill, Van Santen, Steadman & Simpson

[57] ABSTRACT

An enviromental abnormality alarm apparatus includes a plurality of terminals connected to a transmission line and a central processing unit. A specific address is assigned to each of the terminals. The central processing unit sequentially circularly accesses the addresses of the terminals and receives a signal corresponding to a physical change such as a fire, gas leakage, or burglary supplied from each terminal. Each terminal includes an alarm determination reference setting unit, a comparator for comparing the physical change signal with an alarm determination reference value, and an output unit for supplying a comparison result from the comparator. The alarm determination reference value of the alarm determination reference setting unit is set by transmitting and receiving data to and from the central processing unit.

4 Claims, 3 Drawing Sheets

ENVIRONMENTAL ABNORMALITY ALARM APPARATUS

BACKGROUND OF THE INVENTION

1. Field of the Invention

The present invention relates to an environmental abnormality alarm apparatus for detecting a fire, gas leakage, burglary, or the like and generating an alarm.

2. Description of the Prior Art

So-called intelligence type alarm apparatuses are known wherein a common line extends from a central processing unit, a large number of terminals such as fire sensors or gas leakage sensors are connected to this line, the central processing unit sequentially circularly accesses the terminals by address polling, and analog values of the terminals are fetched and calculated, thereby generating an alarm and/or displaying an alarm content. In addition, some apparatuses have a fail-safe capability. That is, in these apparatuses, when the system is down or transmission abnormality of the central processing unit occurs, each terminal directly drives equipment to be controlled by a threshold value circuit provided in each terminal. An example of such an apparatus is described in Japanese Patent Publication (Kokai) No. 60-164802 (FIG. 5) filed by the present assignee. As shown in FIG. 5, a substation 40 functions as a terminal, and its detecting unit 30 detects smoke density, gas density, or the like caused by a fire as an analog value. When the substation 40 is accessed by a central processing unit 10, the analog value is A/D-converted into a digital code value and sent to the central processing unit 10, wherein the necessary calculations are undertaken. In addition, even if transmission is disabled by malfunction or the like of the central processing unit 10, a terminal 31 generates an alarm control output when an output from the detecting unit 30 exceeds a predetermined reference value $E_2$.

A fail-safe output of the above conventional alarm apparatuses is controlled by comparing the analog value from the detecting unit 30 and the fixed second reference value $E_2$. The reference value is changed by changing a resistance or a voltage generating element at the substation 40, resulting in a troublesome operation. In addition, variations are produced by temperature changes or deterioration over time. Furthermore, the reference value cannot be remotely changed from the central processing unit.

SUMMARY OF THE INVENTION

An object of the present invention is to provide an environmental abnormality alarm apparatus in which a reference value can be remotely arbitrarily changed from a central processing unit.

It is a further object of the present invention to provide an environmental abnormality alarm apparatus in which the reference value can be finely accurately set by a digital value.

In order to achieve the above first object of the present invention, there is provided an environmental abnormality alarm apparatus having a plurality of terminals connected to a transmission line, a specific address being assigned to each of the terminals, and a central processing unit for sequentially circularly accessing the addresses of the terminals and receiving a signal indicating a physical change such as a fire, gas leakage, or burglary supplied from each terminal. Each of the terminals has an alarm determination reference setting unit, a comparator for comparing the physical change with an alarm determination reference value, and output means for generating a comparison result from the comparator. The alarm determination reference value of the alarm determination reference setting unit is set by transmitting and receiving data to and from the central processing unit.

In order to achieve the above second object of the present invention, the signals supplied to the central processing unit by the respective terminals are in the form of a digital code or a pulse count. Each alarm determination reference setting means digitally sets an alarm determination reference with respect to the digital code value or the pulse count. A digital comparator compares the digital code value or the pulse count with the alarm determination reference, the alarm determination reference setting means being a memory, and the alarm determination reference being set by transmitting and receiving data to and from the central processing unit.

DESCRIPTION OF THE PREFERRED EMBODIMENTS

Figure 1:
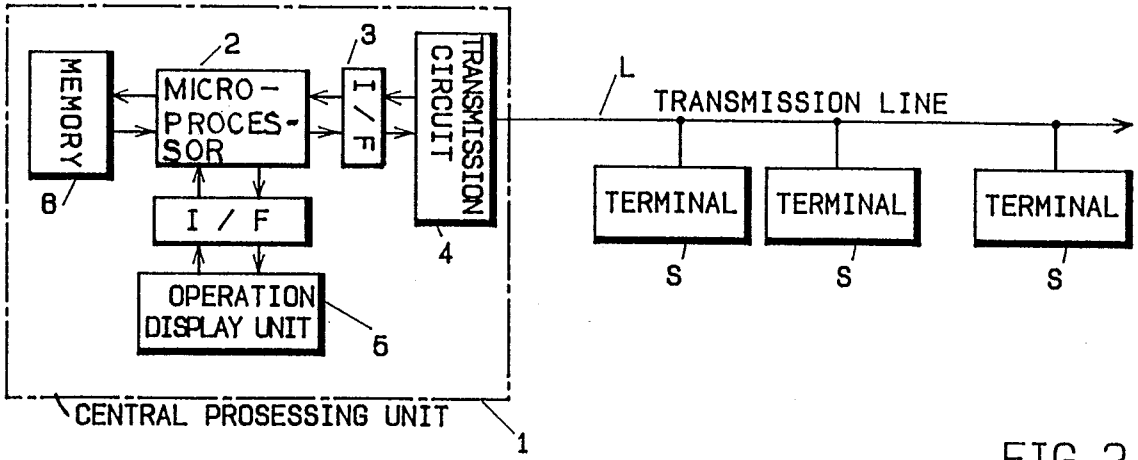
FIG. 1 is a block diagram of an alarm apparatus constructed in accordance with the principles of the present invention.

In FIG. 1, a central processing unit 1 includes a microprocessor 2 from which a transmission line L extends through an interface 3 and a transmission circuit 4. A large number of terminals S are connected to the transmission line L. The microprocessor 2 is connected to an operation display unit 5, which may be a keyboard or an alarm/display unit, and to a memory 6 for storing programs, addresses, reference values and the like. In a normal operation, the central processing unit 1 sequentially circularly accesses terminals S, each having a specific address, and fetches an analog value such as smoke density or a temperature in the form of a current value, a voltage value, or a digital code. The magnitude, a change ratio, and the like of a fetched signal are calculated by the microprocessor 2 to generate an alarm and/or to display an alarm content.

Figure 2:
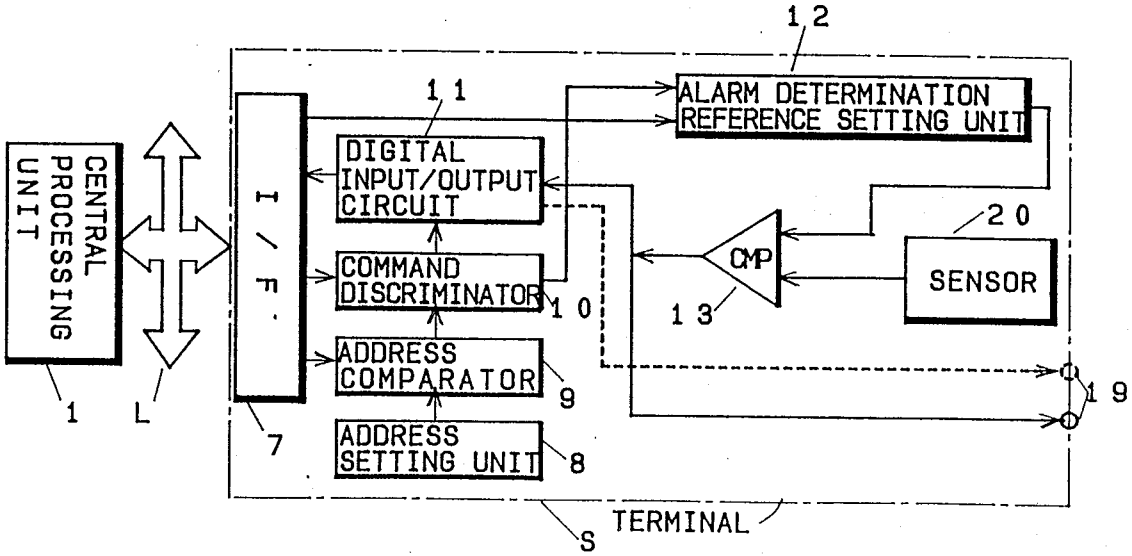
FIG. 2 is a block diagram of a terminal in the apparatus of FIG. 1.

In FIG. 2, the terminal S connected to the transmission line L is shown, having a transmission interface 7, an address setting unit 8, an address comparator 9, a command discriminator 10, a digital input/output circuit 11, an alarm determination reference setting unit 12, a comparator 13, and a sensor 20. In the above arrangement, when the terminal S is subjected to address polling, the command discriminator 10 supplies signals to the digital input/output circuit 11 and the alarm determination reference setting unit 12 in accordance with an output from the address comparator 9.

At this time, if an output from the sensor 20 exceeds a reference value of the alarm determination reference setting unit 12, the comparator 13 generates an output, and an abnormality signal is sent to the central processing unit 1 through the digital input/output circuit 11 and the interface 7.

When the central processing unit 1 determines an abnormality, a control signal is sent to an output means 19 in the terminal S through the digital input/output circuit 11.

If transmission/reception of a transmission signal is disabled by malfunction of the central processing unit 1 or short-circuiting/disconnection of the transmission line L, the output from the comparator 13 in the terminal S is sent from the output means 19, thereby operating equipment to be controlled (not shown).

The reference value of the alarm determination reference setting unit 12 is arbitrarily changed by the central processing unit 1 in accordance with outputs from the transmission interface 7 and the command discriminator 10. Upper and lower limits of the reference value may be set as several steps of a voltage value.

Figure 3:
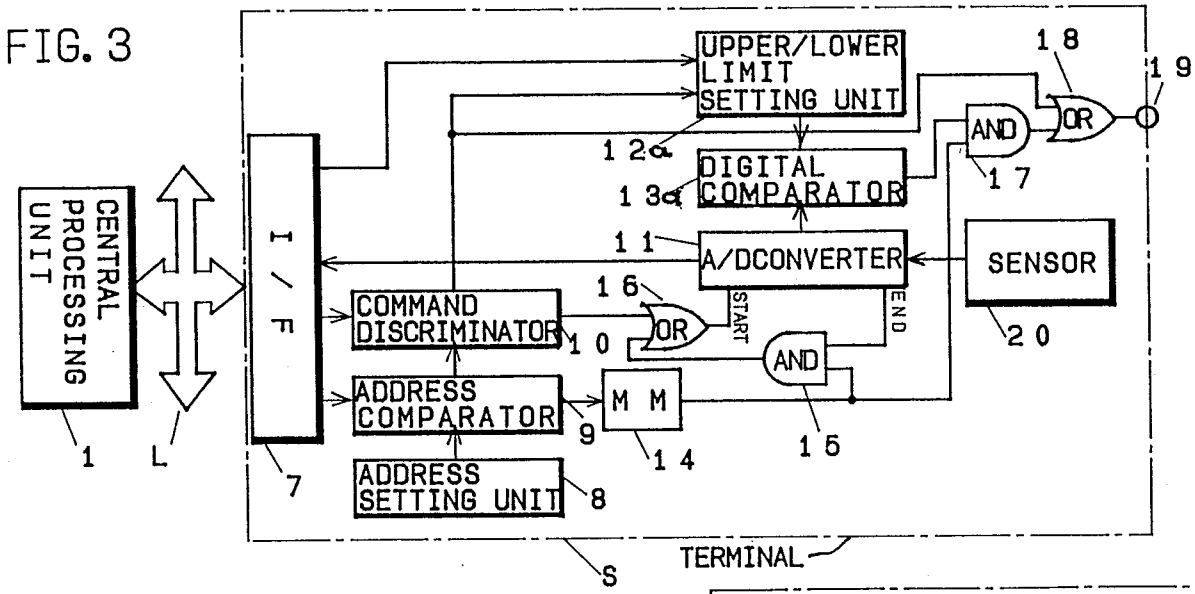
FIG. 3 and 4 are block diagrams of other embodiments of terminals constructed in accordance with the principles of the present invention.
Figure 4:
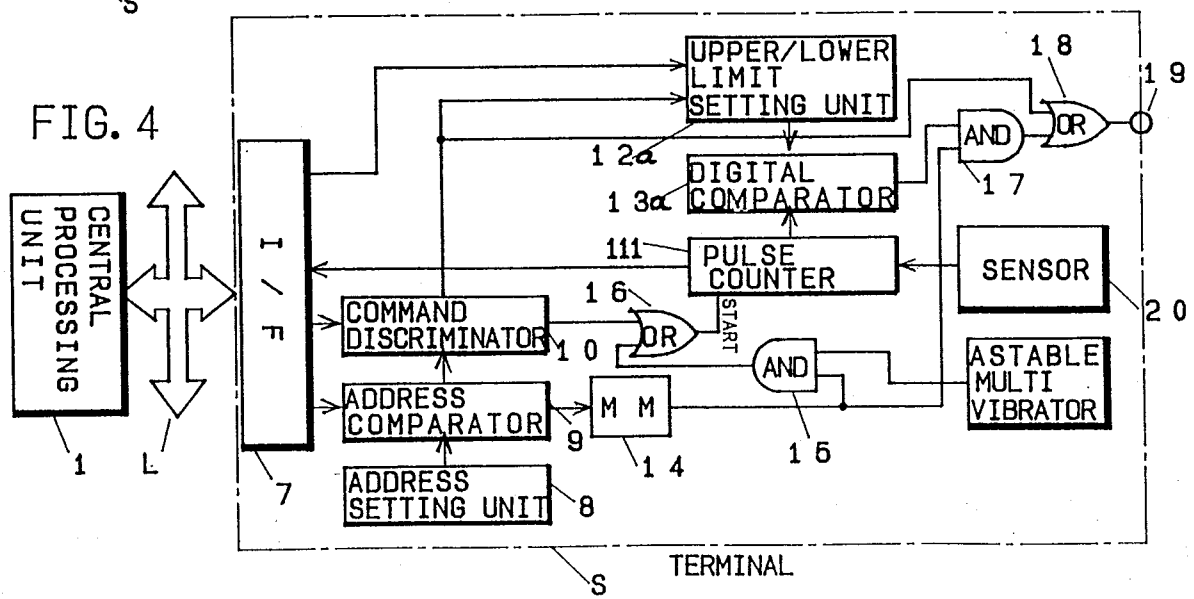
Figure 5:
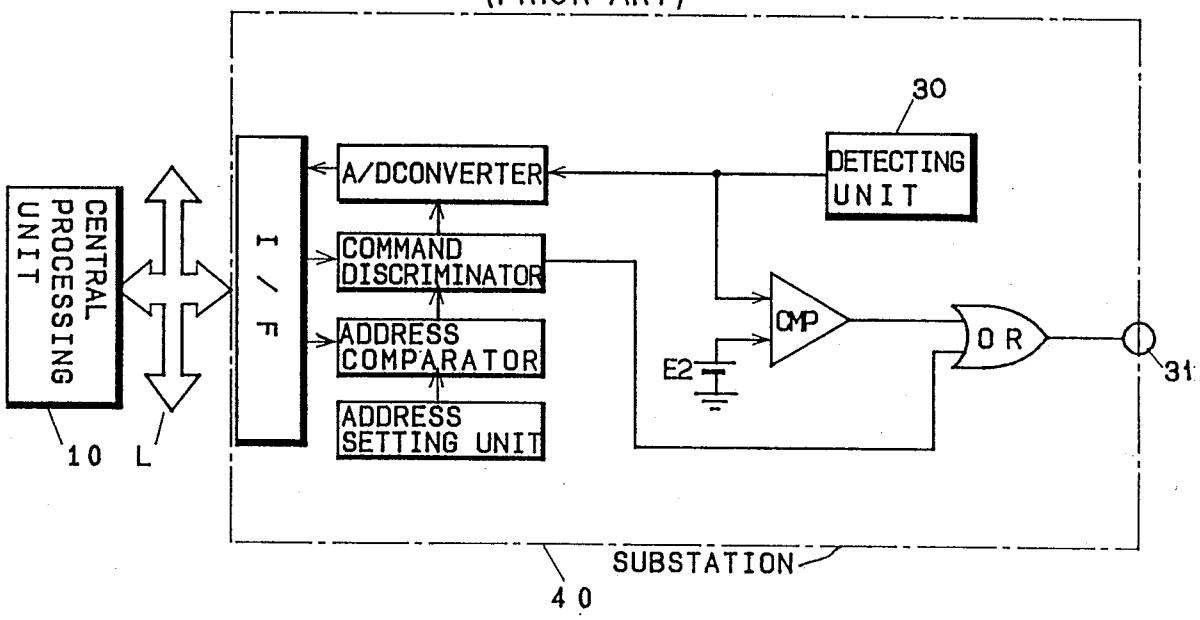
FIG. 5 (PRIOR ART)
FIG. 5 is a block diagram of a conventional apparatus.

FIGS. 3 and 4 are detailed block diagrams of embodiments of the terminal S of the present invention in which all the operations are performed in the form of a digital code.

In FIG. 3, a terminal S connected to a transmission Line L has a transmission interface 7, an address setting circuit 8, an address comparator 9, a comparator discriminator 10, an analog/digital converter 11*a* (to be referred to as an A/D converter hereinafter), an upper/lower limit setting unit 12*a*, a digital comparator 13, and an analog sensor 20. The terminal S also has a timer circuit 14, such as a monostable multivibrator, which does not generate an output when address polling is periodically performed, but generates an output when address polling is not performed for a predetermined period. An output from the timer circuit 14 is supplied to one input terminal of an AND gate 17. The other input of the AND gate 17 receives an output from the digital comparator 13, which compares digital outputs from the upper/lower limit setting unit 12*a*, as an example of an alarm determination reference unit, and the A/D converter 11*a*. A signal obtained through an OR gate 18, to which an output from the AND gate 17 and a control signal from the central processing unit 1 are supplied, is supplied to an output 19 in the terminal S. An AND gate 15 is provided to drive the A/D converter 11*a* when the timer circuit 14 generates an output, while the command discriminator 10 stops generating an output.

With this arrangement, when address polling is performed, the command discriminator 10 supplies a signal to the A/D converter 11*a* in accordance with an output from the address comparator 9, and an analog value from the analog sensor 20 at this time is sent to the central processing unit 1. This operation is repeated by sequentially performing address polling of the terminals S. When the analog value sent to the central processing unit 1 satisfies a predetermined alarm determination reference and the central processing unit 1 determines that a fire is present, the command discriminator 10 causes an output to be generated from the terminal 19 through the OR gate 18, thereby driving equipment to be controlled (not shown).

When an address signal or the like fails to occur by malfunction, such as overrun of the microprocessor 2 of the central processing unit 1 or short-circuiting, disconnection, or the like of signal lines of the transmission line L, the timer circuit 14 operates to supply a signal to the AND gate 17. At this time, if the output from the A/D converter 11 does not satisfy the alarm determination reference, i.e., falls within the range of values of the upper/lower limit setting unit 12*a*, the comparator 13 does not generate an output, and the alarm/display terminal 19 does not generate an output. Thereafter, the A/D converter 11*a* supplies a converted end signal to the AND gate 15. The combination of this signal and an output from the timer circuit 14 is supplied to the A/D converter 11*a* through the OR gate 16, and an output from the analog sensor 20 at this time is A/D-converted and then supplied to the digital converter 13. This operation is repeatedly performed. If the output from the A/D converter 11 satisfies the alarm determination reference, i.e., falls outside the range of set values of the upper/lower limit setting unit 12*a*, the output means 19 generates a signal for driving equipment to be controlled. As a result, an alarm signal similar to that obtained when the central processing unit 1 normally operates can be obtained.

FIG. 4 shows still another embodiment of the present invention. In this embodiment, a pulse counter 111 for conversion of a value from a sensor 20 into a pulse count number is used instead of the A/D converter 11 in FIG. 3. Operations of the other parts are similar to those in FIG. 3. The sensor 20 may be a flame sensor which uses an ultraviolet discharge tube. The pulse counter 111 will then be a circuit in which a discharge pulse changes in accordance with the amount of sensed ultraviolet rays. In FIGS. 3 and 4, when a volatile memory (RAM) or a rewritable EPROM is used as the upper/lower limit setting unit 12*a* which serves as the alarm determination reference unit, the alarm determination reference can be easily set or changed from the central processing unit 1. When the apparatus is installed, the reference value may be written in the alarm reference setting unit 12 in each terminal S from the central processing unit 1.

In the above embodiments in FIGS. 3 and 4, the central processing unit 1 checks whether an output from the sensor is higher or lower than the upper and lower threshold values. However, the present invention is not limited to the above embodiments. For example, storage determination may be performed in consideration of a successive time exceeding the threshold value, or an amount of change in digital value may be checked to obtain the same effect.

As has been described above, according to the apparatus of the present invention, in which equipment to be controlled provided in a terminal can be driven by comparing a fail-safe alarm determination reference value set in the terminal and an output from a sensor, the alarm determination reference value can be remotely arbitrarily changed or set from a central processing unit. In addition, since setting control of the reference value can be performed by a digital value, the reference value can be finely accurately set. As a result, an optimal alarm apparatus with high reliability can be provided.

Although modifications and changes may be suggested by those skilled in the art it is the intention of the inventor to embody within the patent warranted hereon all changes and modifications as reasonably and properly come within the scope of his contribution to the art.

I claim as my invention:

1. An environmental abnormality alarm apparatus comprising:

a plurality of terminals connected to a transmission line, each terminal having sensor means for monitoring an environmental characteristic and for generating an electrical signal corresponding to said characteristic, each terminal having a unique address:

a central processing means connected to said transmission line for sequentially circularly accessing the addresses of said terminals via said transmission line and for receiving said electrical signal from the means for sensing from each terminal;

each terminal further including means for generating an alarm determination reference level and comparator means connected to said means for generating and to said sensor means for comparing said electrical signal with said reference level and generating an output based on the comparison; and means for setting said reference level in said means for generating based on at a received from said central processing means via said transmission line.

2. An environmental abnormality alarm apparatus as claimed in claim 1, wherein said means for generating is a digital memory in which said reference level is stored as a digital value, wherein said means for comparing is a digital comparator, and further comprising means for generating a digital value corresponding to said electrical signal from said sensor means, and wherein said means for setting is means or entering selected digital values in said digital memory.

3. An environmental abnormality alarm apparatus as claimed in claim 2, wherein said means for generating a digital value is an analog-to-digital converter connected between said digital comparator and said means for sensing.

4. An environmental abnormality alarm apparatus as claimed in claim 2, wherein said means for generating a digital value is a digital pulse counter connected between said digital comparator and said sensor means.

* * * * *